United States Patent [19]

Rickert

[11] 4,046,844

[45] Sept. 6, 1977

[54] CARBURETOR CONSTRUCTION

[75] Inventor: Paul Ellis Rickert, Oregon, Ohio

[73] Assignee: Borg-Warner Corporation, Chicago, Ill.

[21] Appl. No.: 701,386

[22] Filed: June 30, 1976

[51] Int. Cl.[2] ..... F02M 17/04

[52] U.S. Cl. ..... 261/34 A; 261/35; 261/41 D; 261/DIG. 39; 261/DIG. 57; 261/DIG. 68

[58] Field of Search ..... 261/DIG. 68, DIG. 57, 261/35, 34 A, 41 D, DIG. 39, DIG. 38

[56] References Cited

U.S. PATENT DOCUMENTS

| | | | |
|---|---|---|---|
| 1,563,705 | 12/1925 | Hansen-Ellehammer | 261/44 A |
| 1,976,912 | 10/1934 | Aseltine | 261/34 A |
| 2,012,665 | 8/1935 | Gustafsson | 261/34 A |
| 2,082,293 | 6/1937 | Linga | 261/34 A |
| 2,084,489 | 6/1937 | Hess | 261/DIG. 56 |
| 2,186,480 | 1/1940 | Ensign | 261/34 A |
| 3,109,043 | 10/1963 | Carlson et al. | 261/41 D |
| 3,326,539 | 6/1967 | Phipps | 261/41 D |
| 3,404,872 | 10/1968 | Nutten | 261/34 A |
| 3,469,825 | 9/1969 | Du Bois | 261/DIG. 38 |
| 3,738,623 | 6/1973 | Tuckey | 261/DIG. 68 |

*Primary Examiner*—Tim R. Miles
*Attorney, Agent, or Firm*—Herman E. Smith

[57] ABSTRACT

A carburetor construction is disclosed which includes a plurality of plate members stacked one upon the other, the plates including recesses and openings which define fuel channels, and cavities which nestibly receive various components of the carburetor, the components being designed so as to facilitate assembly with each other.

11 Claims, 35 Drawing Figures

74
75
76
77
73
54
71
72
69
70
68
67
63
64
65
209
66
203
231
53
182
181
55
96
94
60
62
92
95
113
93
61
59
56
58
57
98
84
85
82
86
83
51
81

338
7
84
75
76
7.
63
69
70
70
54
55
77
8.
8.
83
78
58
74
73
200
50

54
52
83
53
51
58
81
200
50

58
74
103
200
78
117
81
77
51
119
55
121
56
76
338
79
75
50

FUEL

CARBURETOR CONSTRUCTION

BACKGROUND OF THE INVENTION

1. Field.

The present invention is directed to improvements in carburetors and more particularly to improvements in the construction of carburetors wherein separately formed component members are combined to provide a carburetor assembly.

2. Prior Art.

Carburetors are known to include complex systems of passages which are difficult to cast and drill, and to include numerous components which are difficult to assemble such as throttle plates, inlet valves, needle valves, orifice members and the like. Efforts have been made to simplify the manufacture of carburetors by means of subassemblies, however, some of the difficulties still remain particularly with respect to the drilling of intersecting passages, and the assembly of components such as throttle plates, needle valves, inlet valves and the like.

SUMMARY OF THE INVENTION

The present invention relates to improvements in carburetors constructed from asembled components wherein the several components are formed for ease of engagement with adjacent components, at least some of the components including simple patterns of recesses and apertures which in combination with adjacent components provide a desired system of passages.

The various components may be formed so as to virtually eliminate machine surface finishing, and may be formed of various materials such as metal, or synthetic resins.

The patterns of apertures and recesses in the component members are susceptible to arrangement in a manner to provide auxiliary functions in combination with the system of fuel passages such as a metering chamber, fuel pump and accelerator pump.

The components are formed for ease of assembly with each other, certain of the components being nestible with respect to each other and certain components providing interlocking means whereby adjacent components are located in a desired relationship.

Further, interchangeable components may be used in the assembly where modifications of fuel or air passages or auxiliaries are desirable for use with particular engines.

DRAWINGS

Figure 20:
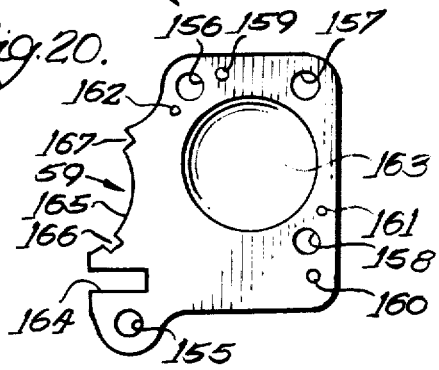
Figure 21:
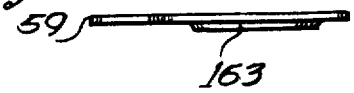
Figure 22:
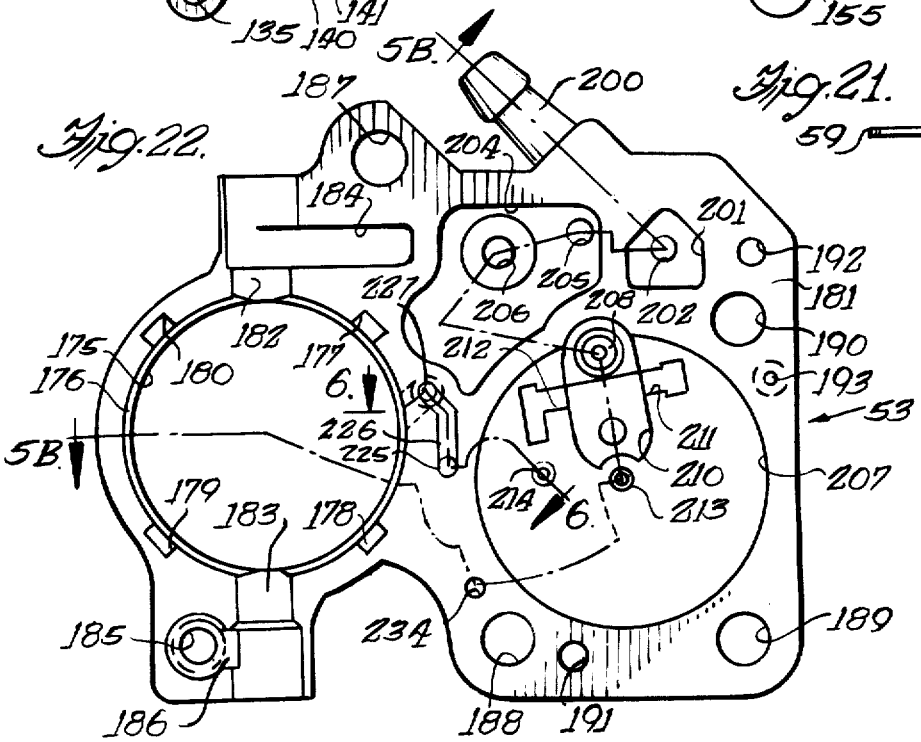
Figure 23:
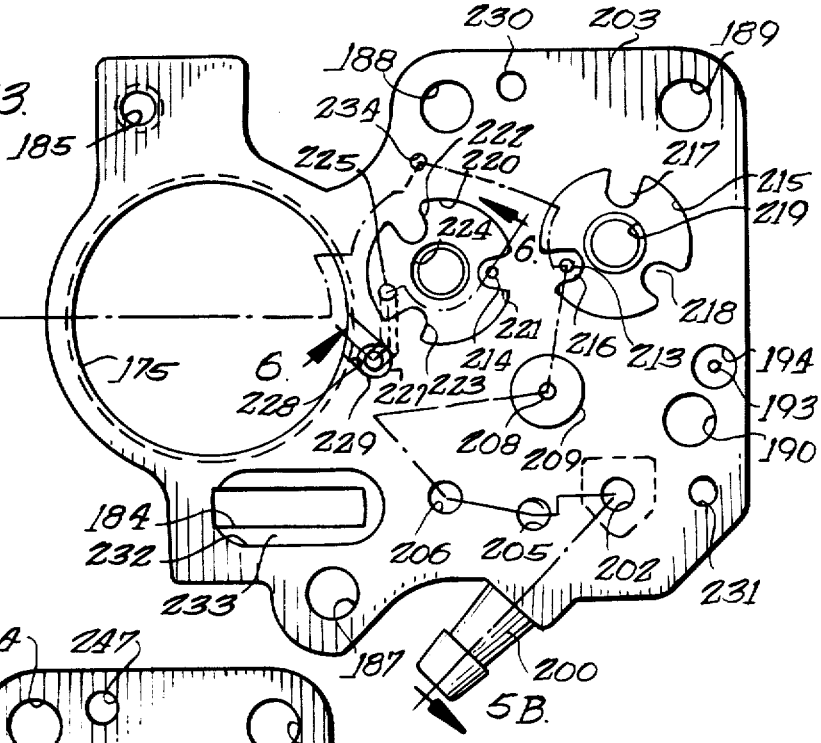
Figure 24:
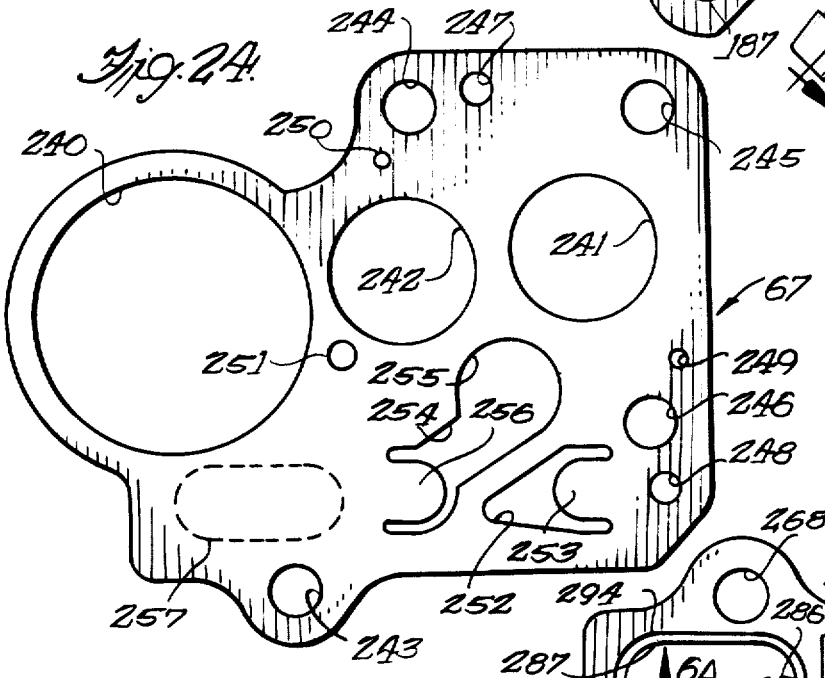
Figure 25:
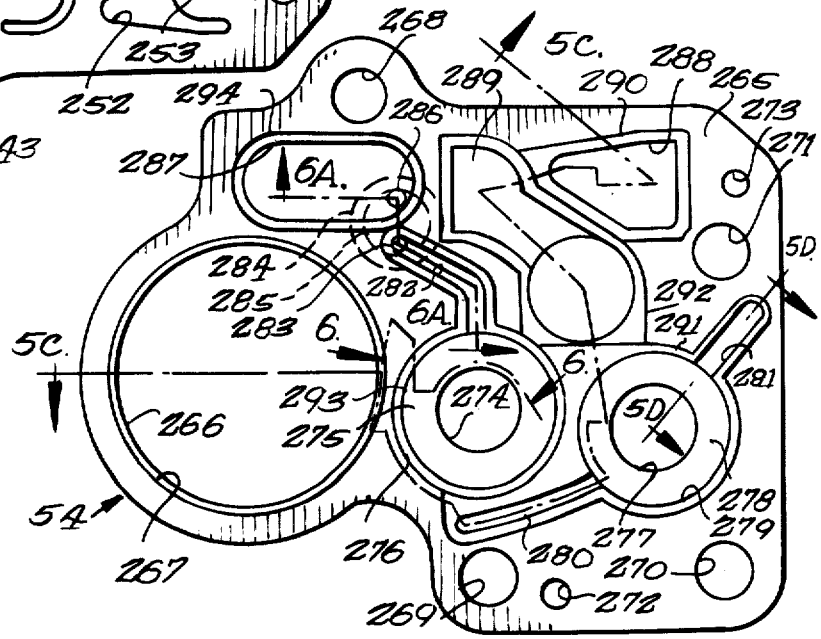
Figure 26:
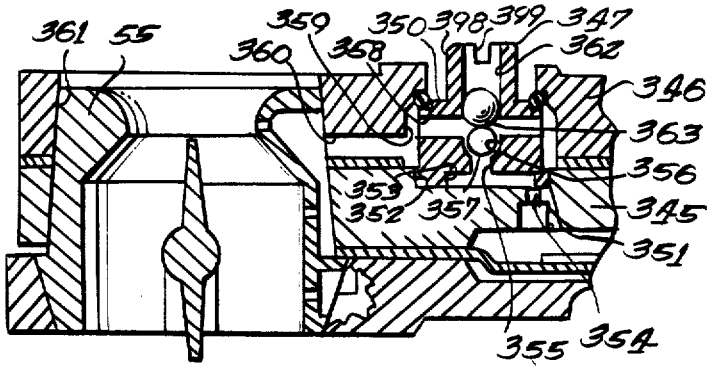
Figure 27:
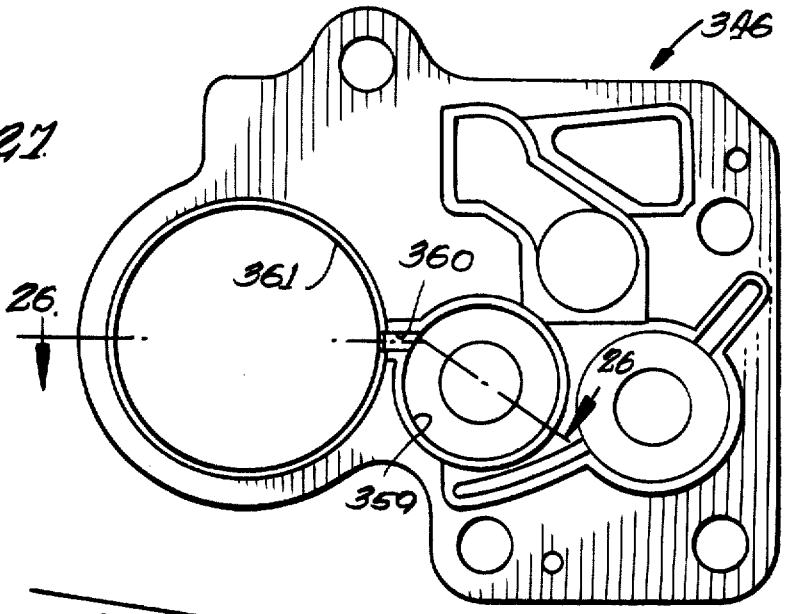
Figure 28:
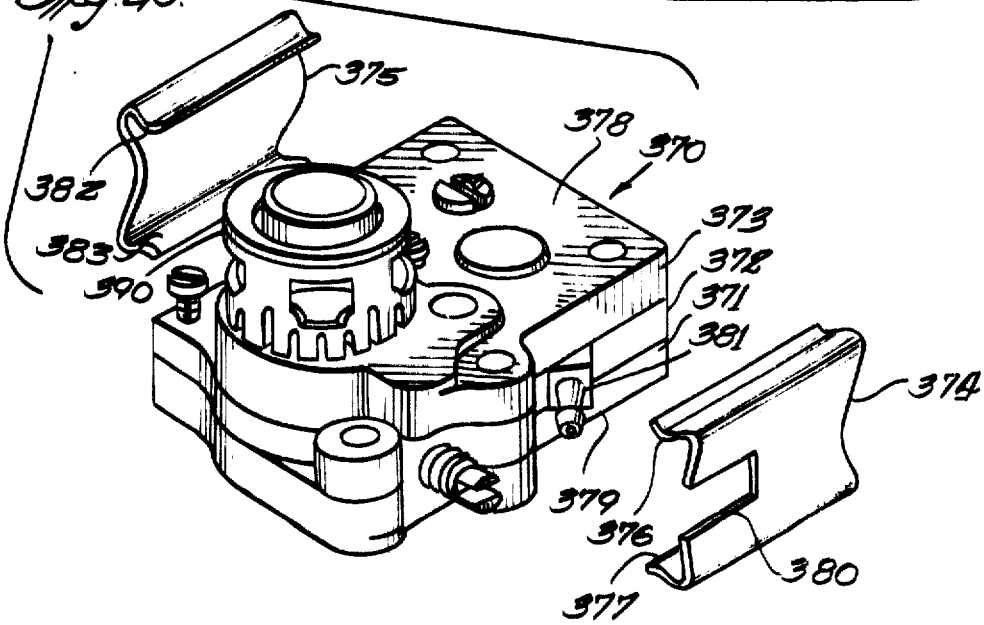
Figure 31:
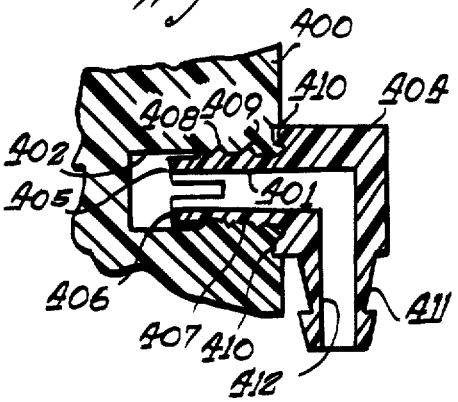
Figure 32:
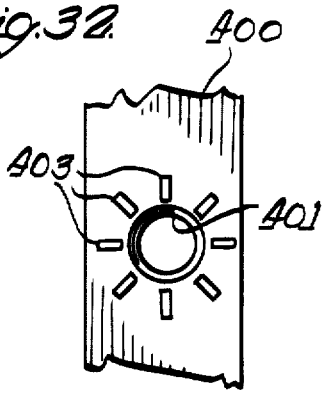
Figure 34:
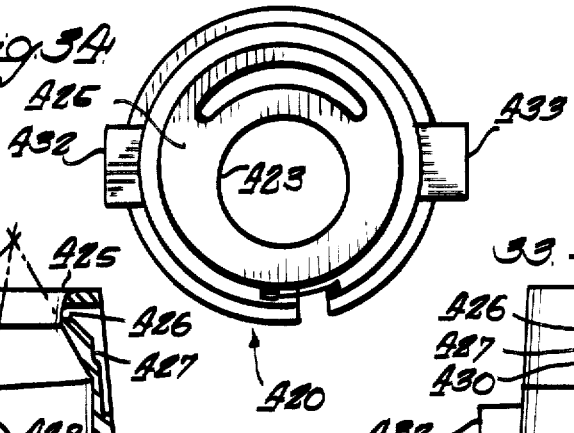
Figure 33:
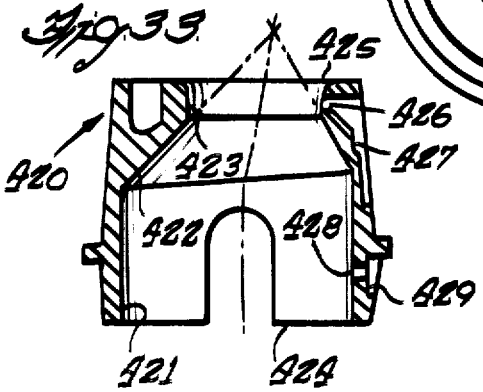
Figure 35:
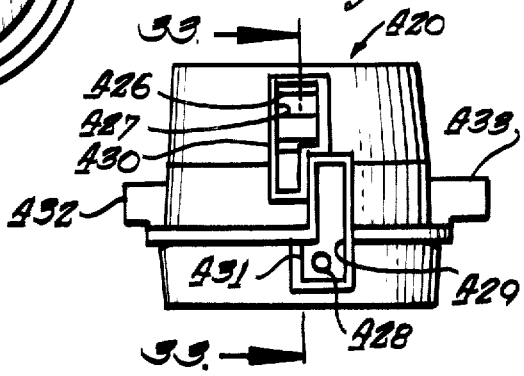

FIGS. 20, 21 ar plan and side views respectively of a lower diaphragm;

FIG. 22 is a plan view to enlarged scale of the lower surface of a metering plate forming a portion of a fuel module;

FIG. 23 is a plan view to enlarged scale of the upper surface of the metering plate shown in FIG. 22;

FIG. 24 is a plan view to enlarged scale of an upper diaphragm;

FIG. 25, is a plan view to enlarged scale of the lower surface of a cover plate forming a portion of a fuel module;

FIG. 26 is a fragmentary section view to enlarged scale showing an alternate embodiment of fuel adjusting plug;

FIG. 27 is a plan view to enlarged scale of the lower surface of a cover plate for the embodiment of FIG. 26;

FIG. 28 is a perspective view to enlarged scale of an alternate embodiment of carburetor construction;

FIGS. 29, 30, 31, 32 are fragmentary views to enlarged scale showing detail of a modified form of carburetor; and FIGS. 33, 34, 35 are section, top and side views respectively, to enlarged scale, showing a further alternate embodiment of a throat member.

DESCRIPTION OF THE PREFERRED EMBODIMENTS

Figure 1:
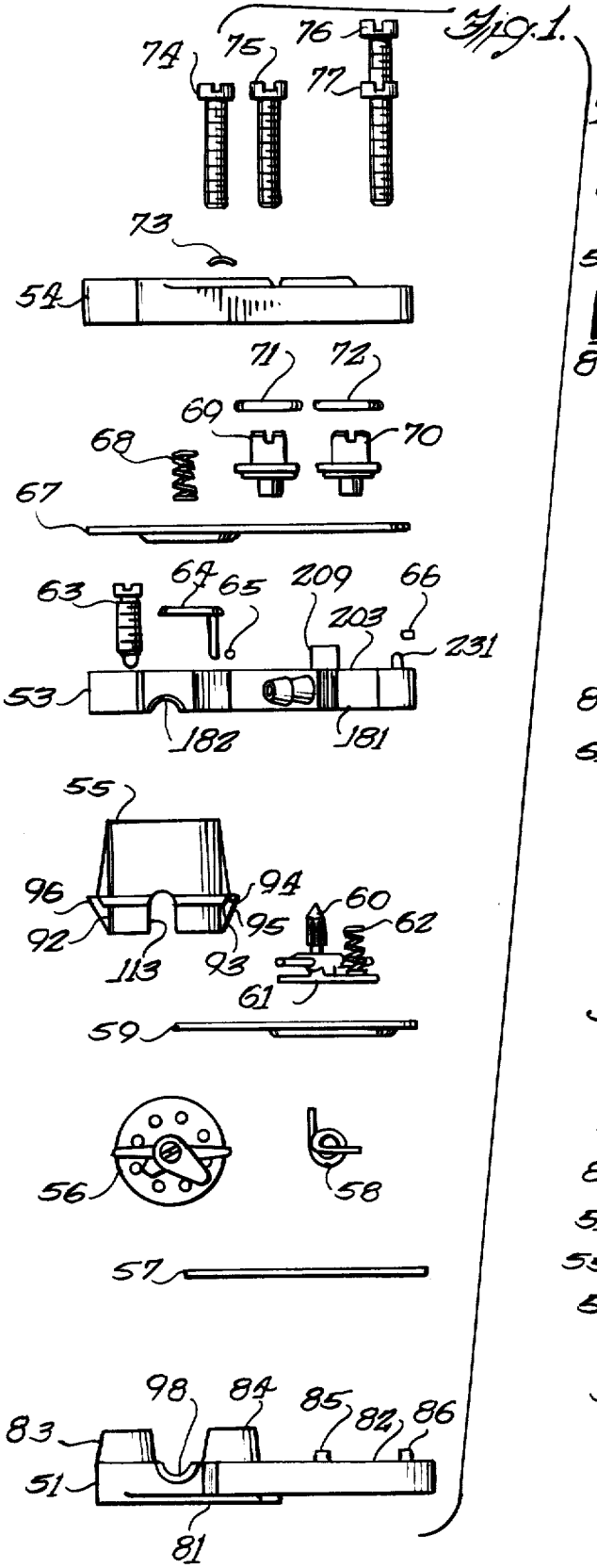
FIG. 1 is an exploded view of components of a carburetor construction according to the present invention.
Figure 2:
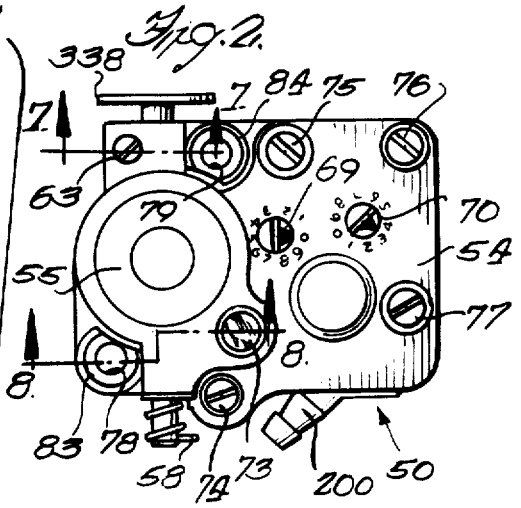
FIG. 2 is a top view of a carburetor assembled for components shown in FIG. 1.
Figure 3:
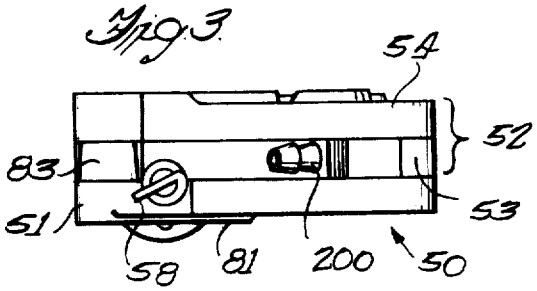
FIG. 3 is a side view of the carburetor shown in FIG. 2.
Figure 4:
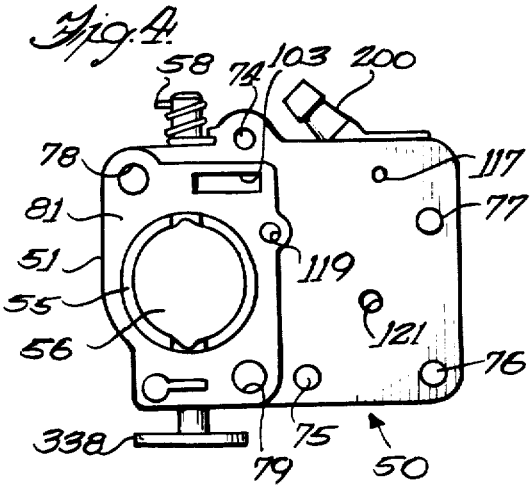
FIG. 4 is a bottom view of the carburetor shown in FIG. 2.

Referring initially to FIGS. 1–4 there is shown an improved carburetor construction 50, the components thereof being shown in disassembled relationship in FIG. 1. In somewhat more detail, the carburetor includes a base plate 51, a fuel module 52 including a metering plate 53 and a cover plate 54, a throat member 55 defining a mixing passage and a throttle member 56. Base plate 51, metering plate 53 and cover plate 54 include grooves, recesses, channels and openings, to be described in more detail hereinafter, which nestibly receive other components of the carburetor and serve to retain the various components in desired relationship to each other. In addition to the above named components, FIG. 2 shows a gasket 57, throttle return spring 58, lower diaphragm 59, fuel inlet valve 60, valve lever 61, valve spring 62, throttle adjusting screw 63, accelerator pump shoe 64, ball check 65, air bleed insert 66, upper diaphragm 67, accelerator pump return spring 68, high speed adjusting plug 69, idle adjusting plug 70, resilient collars 71, 72 for respective adjusting plugs, a sight glass 73, and retaining screws 74, 75, 76, 77.

Figures 5, 6, 7, 8:
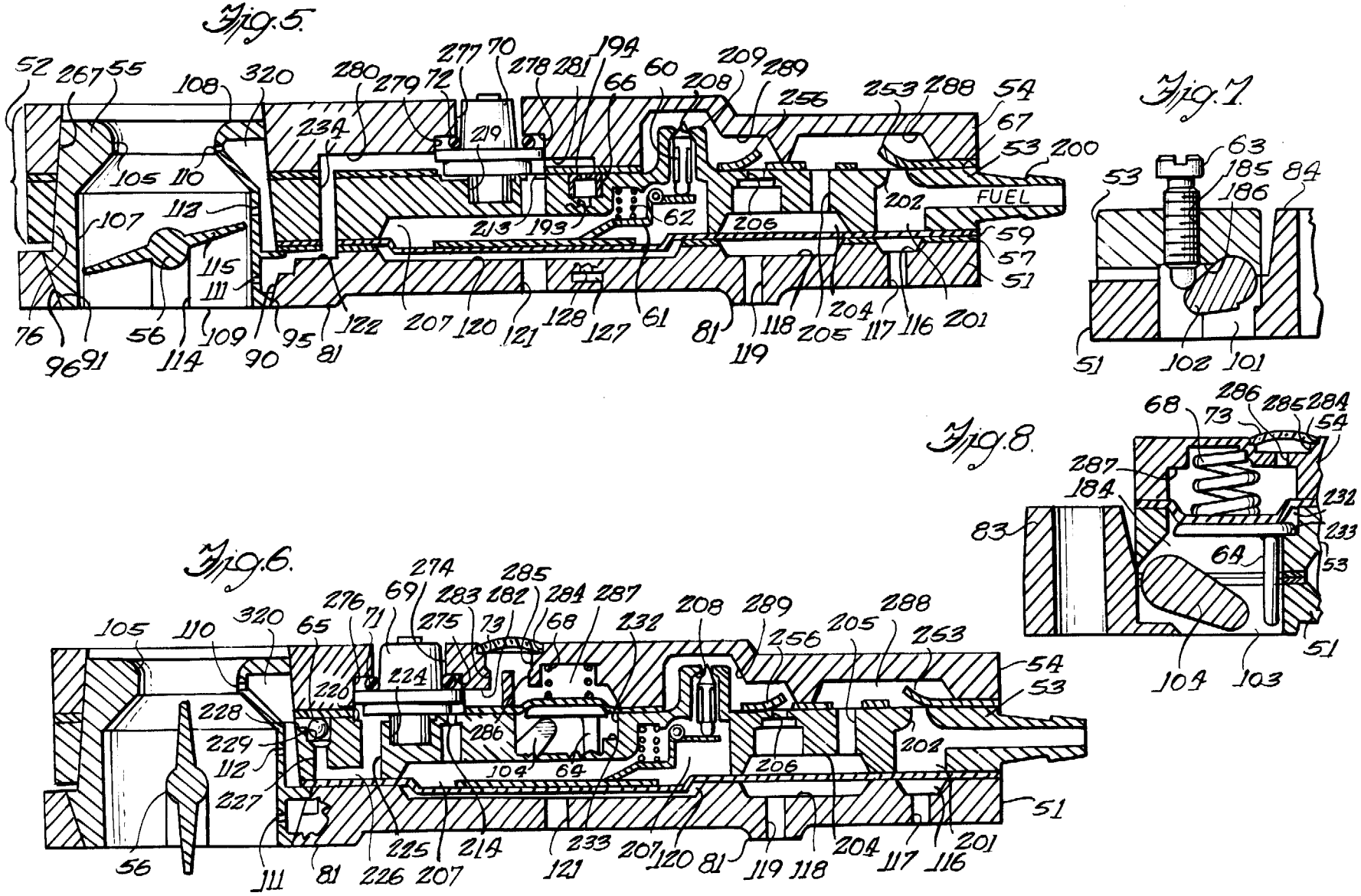
FIG. 5 is a schematic view of the carburetor illustrating operation at idle condition.
FIG. 6 is a schematic view similar to FIG. 5 illustrating operation at open throttle condition.
FIG. 7 is a fragmentary section view showing detail of throttle adjusting means to enlarged scale, taken along the line 7—7 of FIG. 2.
FIG. 8 is a fragmentary section view showing detail of accelerator pump means to enlarged scale, taken along the line 8—8 of FIG. 2.

Referring now to FIGS. 5 and 6, the nested relation of components is shown to enlarged scale in vertical dimension while the longitudinal dimension has been distorted in an effort to show the path of the fuel channels in planar view, certain of the components being displaced for the sake of clarity in illustrating their functional interaction with adjacent components. The recesses and cavities shown schematically in FIGS. 5 and 6 are shown in true relationship in detailed views of the base plate, metering plate and cover plate found in FIGS. 18 through 25, to which reference may be had.

Referring now to FIGS. 1, 4, 5 and 18, the base plate 51 will be described in more detail. Base plate 51 includes a lower surface 81 adapted for mounting on a flange surrounding the air inlet of an internal combustion engine. The upper surface of base plate 51 includes a substantially planar surface portion 82 interrupted by upstanding mounting bosses 83, 84, locating pins 85, 86, and by various grooves, recesses and openings described below. Mounting bosses 83, 84 include mounting holes 78, 79 to receive screws for securing the carburetor to an engine.

Base plate 51 includes a major opening 87 having a shoulder porton 88 and a beveled portion 89 defining a socket for receiving throat member 55. Beveled key slots 90, 91 are formed in the opening for positioning throat member 55 with respect to base plate 51. As seen in FIG. 1, throat member 55 is provided with a cylindrical portion 92 for engaging opening 87, a shoulder 93 for engaging shoulder portion 88, a beveled edge 94 for engaging beveled portion 89, and beveled key portions 95, 96 for engaging key slots 90 and 91. The circumferentially disposed key portions and key slots serve to locate the throat member in a selected relationship to the base plate, while the beveled surfaces provide fluid tight seals which are easy to assemble.

Figure 17:
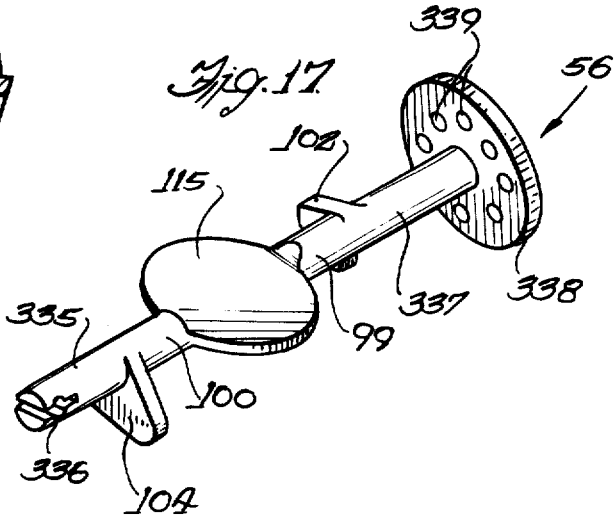
FIG. 17 is a perspective view of a throttle member shown to enlarged scale.

Parti-cylindrical grooves 97, 98 are formed in planar surface portion 82 extending so as to intercept opening 87. The parti-cylindrical grooves 97, 98 provide bearing surfaces for journal portions 99, 100 of rotatable throttle member 56. Parti-cylindrical surface 97 is intercepted by a small opening 101 for receiving idle air adjusting cam 102 of throttle member 56. Similarly, parti-cylindrical surface 98 is intercepted by a second small opening 103 arranged for receiving accelerator pump cam 104 of throttle member 56. FIGS. 7, 8 and 17 show the cams 102, 104 related to throttle member 56 and base plate 51.

The interlocking engagement of base plate 51 with throat member 55 and throttle member 56 can be seen in the left hand portion of FIG. 5. In the configuration shown in FIG. 5, throat member 55 is formed with a restricted band 105, defining a venturi section, a frustoconical section 106 and a cylindrical section 107, between the air inlet end 108 and the air outlet end 109, defining a fuel and air mixing passage. A main fuel aperture 110 penetrates a wall portion of throat member 55 in the vicinity of restricted band 105, and an idle fuel aperture 111 penetrates the wall in the cylindrical portion of the mixing passage. Additional fuel apertures such as transitional orifice 112 may penetrate the wall if desired. Throat member 55 includes slots 113, 114 arranged for embracing throttle member 56 such that throttle plate portion 115 thereof bears a selected relationship to the fuel apertures 110, 111 and 112.

Figure 18:
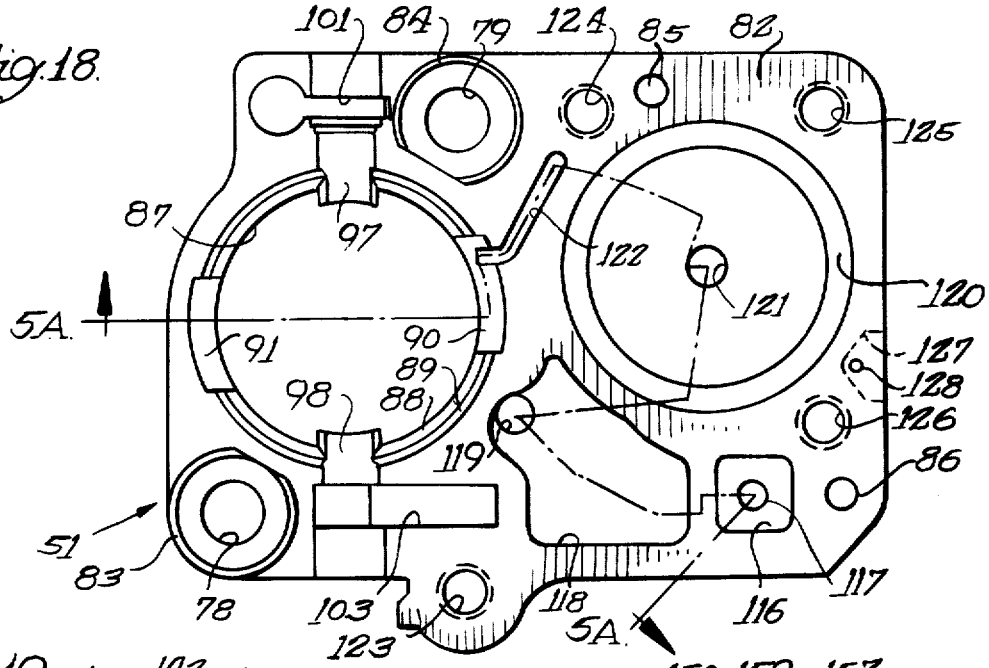
FIG. 18 is a view of the upper surface of the base plate shown to enlarged scale.

Continuing now with the description of further openings and recesses in base plate 51 reference is made to FIG. 5 and FIG. 18 wherein the section line 5A-5A generally indicates the section view shown in FIG. 5. Recess 116 is open to atmosphere through vent 117 and cooperates with lower diaphragm 59 to form a bounce chamber for reducing pulsation in the fuel channels of fuel module 52. Adjacent recess 118 opens through lower surface 81 by means of opening 119 adapted for communication with a source of pulsating pressure such as the crankcase of an internal combustion engine. Recess 118 in cooperation with a portion of diaphragm 59 provides a pulse operated fuel pump. The next adjacent recess 120 is open to atmosphere through vent 121, and in cooperation with a portion of lower diaphragm 59 provides the dry side portion of a metering chamber. An idle fuel channel 122 is recessed into planar surface 82 and opens into beveled key slot 90 for communication with idle fuel aperture 111 in throat member 55. Base plate 51 also includes four threaded holes 123, 124, 125, 126 for receiving retaining screws 74, 75, 76, 77. Further, base plate 51 includes an air bleed inlet 127 and an air bleed outlet 128.

Figure 19:
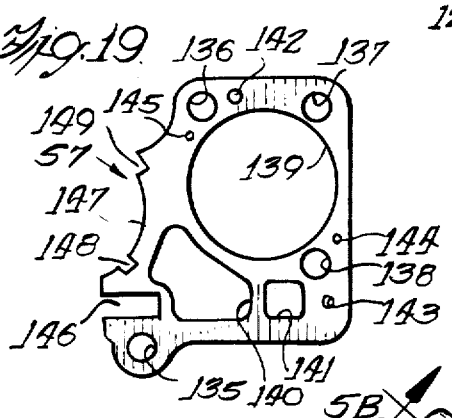
FIG. 19 is a plan view of a gasket.

Referring now to FIG. 19, the gasket 57 is shown to a scale different from that of FIG. 18, however, it is believed that the openings in gasket 57 can be readily associated with the corresponding recesses and openings in base plate 51. For example, the four openings 135, 136, 137, 138 correspond with threaded holes 123, 124, 125, 126 permitting passage of retaining screws 74, 75, 76, 77. In a similar fashion, circular opening 139 corresponds with metering chamber recess 120, irregular opening 140 corresponds with pump chamber recess 118, and square opening 141 corresponds with bounce chamber recess 116. Small openings 142, 143 receive locating pins 85 and 86. Aperture 144 corresponds with air bleed outlet 128, and idle fuel aperture 145 overlies idle fuel channel 122. Rectangular cutout 146 corresponds with acclerator pump cam opening 103. Arcuate edge 147 is adjacent socket opening 87 when in place on base plate 51 and may, if desired, include one or more notches 148, 149 which can be arranged in a coded pattern. Where multi-purpose and or interchangeable throat members are available, a coded notch pattern on gasket 51 can be employed for the purpose of checking the identification and orientation of a throat member.

Lower diaphragm 59 forms a resilient membrane between base plate 51 and fuel module 52, and is shown in FIGS. 20 and 21 to a scale similar to that of gasket 57 in FIG. 19. Diaphragm 59 is formed preferably of a flexible resilient rubber-like material of a composition resistant to deterioration in the presence of petroleum products. Lower diaphragm 59 includes four openings 155, 156, 157, 158 to permit passage of retaining screws 74, 75, 76 and 77. Small openings 159, 160 are arranged to receive locating pins 85, 86. Air bleed aperture 161 is arranged to communicate with air bleed outlet 128 when in place on base plate 51. Idle fuel aperture 162 is arranged for communication with idle fuel channel 122 when in place. A depression 163 is formed in lower diaphragm 59 arranged for nesting in metering chamber recess 120 of base plate 51. A rectangular cutout 164 corresponds with accelerator pump cam opening 103 and arcuate edge 165 is formed to lie adjacent socket opening 87. A pattern of coded notches such as 166, 167 may be included if desired as in the case of the gasket 57.

Referring now to fuel module 52, metering plate 53 is shown in bottom plan view in FIG. 22 and in top plan view in FIG. 23, the schematic section view of FIG. 5 being taken substantially along the section lines 5B-5B. The openings and recesses in metering plate 53 which are congruent with cooperating openings and recesses in base plate 51 are shown in more detail in FIG. 22.

A large opening 175 is included in metering plate 53 arranged for embracing a throat member 55. Opening 175 includes a tapered surface 176 arranged for engaging portions of a throat member to form a fluid tight seal adjacent the fuel apertures therein. A coded pattern of notches such as 177, 178, 179, 180 may be formed adjacent opening 175 for the purpose of correlating a metering plate with a selected one of interchangeable throat members. Lower surface 181 of metering plate 53 includes a pair of parti-cylindrical grooves 182, 183 providing bearing surface for journal portions 100, 99 of throttle member 56. An accelerator pump cam opening 184 intercepts bearing surface 182, while a threaded opening 185 and recess 186 are formed adjacent bearing surface 183 to receive throttle adjusting screw 63. Four through holes 187, 188, 189, 190 are provided to permit passage of retaining screws 74, 75, 76 and 77 through the metering plate. A pair of small recesses 191, 192 are arranged to receive locating pins 85 and 86 of base plate 51. An air bleed aperture 193 is arranged for communication with air bleed outlet 128 of base plate 51.

Metering plate 53 is provided with a fuel inlet tube connector 200 communicating with a fuel cavity 201. An opening 202 extends from fuel cavity 201 through top surfce 203 of metering plate 53 defining a valve seat. Fuel cavity 201 is arranged to overlie bounce chamber recess 116 of base plate 51.

A fuel pump recess 204 is formed adjacent fuel cavity 201 arranged to overlie fuel pump recess 118 in base plate 51. Fuel pump recess 204 includes an inlet opening 205 and an outlet opening 206 defining a valve seat.

A wet side metering chamber recess 207 is formed in lower surface 181 of metering plate 53 arranged to overlie dry side metering chamber recess 120 of base plate 51. An inlet valve seat 208 is formed in a raised boss 209 projecting from top surface 203, the valve seat 208 being arranged for cooperation with fuel inlet valve 60. Metering chamber recess 207 includes further recessed portions 210, 211, 212 providing mounting surface for valve lever 61 and valve spring 62. A small socket 194 is recessed into top surface 203 concentric with air bleed aperture 193 arranged to receive cup-like air bleed insert 66.

An idle fuel metering orifice 213 is in communication with metering chamber recess 207 and penetrates top surface 203 of metering plate 53. A high speed or main fuel metering orifice 214 is spaced from idle orifice 213 and also communicates with metering chamber recess 207 and penetrates top surface 203 as shown in FIGS. 22 and 23, metering orifices 213, 214 are shown as circular apertures, however, other shapes of apertures may be employed. For example, one desirable aperture configuration is in the form of a triangle having converging edges. The aperture configuration of a metering orifice is selected in combination with the metering surface of an associated adjusting plug 69 or 70 so as to provide a desired variation in flow area in response to rotation of the adjusting plug.

Referring to FIG. 23 a recess 215 is formed in top surface 203 adjacent idle fuel orifice 213. Recess 215 is of a shape which defines three radial extension portions 216, 217, 218 of top surface 203 upon which the metering surface of adjusting plug 70 rests. Extension 216 provides a metering surface surrounding orifice 213. A well 219 is formed adjacent radial extension portion 216 arranged for receiving a projecting portion of adjusting plug 70. The opening of well 219 with respect to idle orifice 213 is selected with reference to the configuration of metering surface on adjusting plug 70. A preferred configuration of metering surface is similar to the surface defined by ledge 305 of metering plug 69, shown in FIG. 11, the metering plugs 69 and 70 being substantially identical.

A similar recess 220 is formed in top surface 203 adjacent main fuel orifice 214. Recess 220 defines three radial surface extensions 221, 222, and 223 for supporting high speed adjusting plug 69 and includes a well 224 for locating plug 69 with respect to orifice 214. Extension 221 provides a metering surface surrounding orifice 214. Recess 220 includes a fuel outlet opening 225 which communicates with high speed fuel channel 226 in lower surface 181 of metering plate 53. High speed fuel channel 226 in turn communicates with opening 227 which penetrates recess 228. A counterbored portion 229 of recess 228 provides a valve seat for check ball 65.

The high speed portion of the fuel channel means including metering chamber 207, high speed orifice 214, recess 220, opening 225, channel 226, opening 227 and recess 228 is shown schematically in FIG. 6.

Referring to FIG. 23, top surface 203 of metering plate 53 includes a pair of aligning pins 230, 231 projecting therefrom. A recess 232 is formed in top surface 203 surrounding accelerator pump opening 184 and defines a stop surface 233 arranged for limiting movement of accelerator pump shoe 64.

An idle fuel channel opening 234 extends between top surface 203 and lower surface 181 of metering plate 53 as shown in FIGS. 5, 22 and 23.

Upper diaphragm 67 forms a resilient membrane between metering plate 53 and cover plate 54, and is shown in plan view in FIG. 24. Diaphragm 67 is formed preferably of a flexible resilient rubber-like material of a composition resistant to damage from contact with petroleum based products.

Upper diaphragm 67 includes a large opening 240 corresponding with opening 175 in metering plate 53, and a pair of smaller openings 241, 242 corresponding with recesses 215 and 220 respectively of metering plate 53. A pattern of four holes 243, 244, 245 and 246 is arranged to permit passage of retaining screws 74, 75, 76 and 77. A pair of openings 247 and 248 is arranged for receiving aligning pins 230 and 231 projecting from metering plate 53. An air bleed aperture 249 is located for communication with air bleed aperture 193 in metering plate 53. An idle fuel aperture 250 is located for alignment with idle fuel channel opening 234 in metering plate 53. A further opening 251 is located for alignment with valve seat 229 in order to facilitate assembly of ball check 65. The opening 252 is arranged to overlie pump inlet opening 205 and defines a flap valve portion 253 arranged to overlie opening 202 in metering plate 53. Opening 254 includes a distant portion 255 arranged to receive raised boss 209. Opening 254 also defines a flap valve 256 arranged to overlie pump outlet opening 206. The broken line 257 is shown in FIG. 24 to indicate a portion of diaphragm 67 which is flexed with respect to recess 232 by operation of accelerator pump shoe 64.

Cover plate 54 is described in more detail below referring to FIGS. 5, 6 and 25. The lower surface 265 of cover plate 54 is shown in plan view in FIG. 25, while various sections are shown in FIGS. 5 and 6 taken generally along the section lines 5C—5C, 5D—5D and 6—6 and 6A—6A of FIG. 25. A large through opening 266 is formed in cover plate 54 provided with a tapered wall 267 arranged for embracing throat member 55. A pattern of four mounting holes 268, 269, 270 and 271 is arranged to permit passage of retaining screws 74 - 77. A pair of small recesses 272, 273 is arranged to receive aligning pins 230 and 231 of metering plate 53. An opening 274 is formed in cover plate 54 arranged to overlie well recess 224 in metering plate 53. A shoulder 275 and cylindrical wall 276 are concentrically disposed about opening 274 and form, in combination with recess 220 and surface 221, a pocket for receiving high speed adjusting plug 69. A similar opening 277 is formed adjacent opening 274 and is surrounded by a shoulder 278 and cylindrical wall 279 defining a pocket arranged for receiving idle adjusting plug 70, the idle pocket being related to recess 215 and metering surface 216 of metering plate 53. A narrow elongated recess or channel 280 extends from cylindrical wall 279 to a point where it will overlie idle fuel channel opening 234 in metering plate 53. Another narrow elongated recess or channel 281 extends from cylindrical wall 279 to a point where it will overlie air bleed aperture 193 of metering plate 53. Recess 280 extends along a portion of section line 5C—5C of FIG. 25 which recess 281 extends along section line 5D—5D thereof. The recesses 280 and 281 are shown in section in FIG. 5 in association with idle adjusting plug 70. A third narrow recess or channel 282 extends from cylindrical wall 276 of the high speed adjusting pocket to a point intercepting accelerator pump aperture 283. A stepped recess 284, 285 is shown in broken lines in FIG. 25 indicating that the stepped recess is formed in the upper surface of cover plate 54 where it serves to mount the sight glass 73. An aperture 286 communicates the stepped recess 284, 285 with accelerator pump recess 287. The relationship of the accelerator pump recess 287 with the aperture 286, 283, recess 284, 285, channel 282 and high speed pocket 276 is shown in section in FIG. 6, being taken substantially along the line 6A, 6A of FIG. 25.

A recess 288 is formed in lower surface 265 of cover plate 54 arranged to provide communication between openings 202 and 205 of metering plate 53. An adjacent recess 289 in surface 265 is arranged to provide communication between opening 206 and inlet valve seat 208 of metering plate 53.

Ridges such as 290–294 are formed on surface 265, surrounding the recesses formed therein. The ridges, indent diaphragm 67 when the carburetor is assembled and serve to isolate one recess from adjacent recesses.

Figure 9:
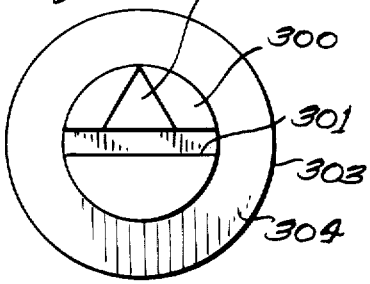
FIGS. 9, 10, 11 are top, side and bottom views respectively of a typical rotatable fuel adjusting plug shown to enlarged scale.
Figure 10:
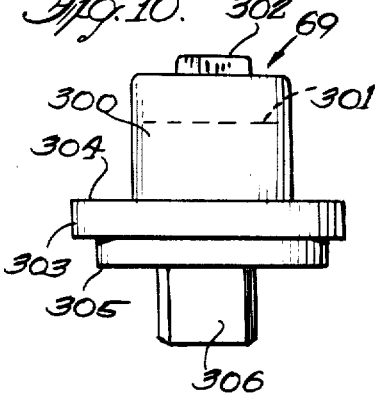
Figure 11:
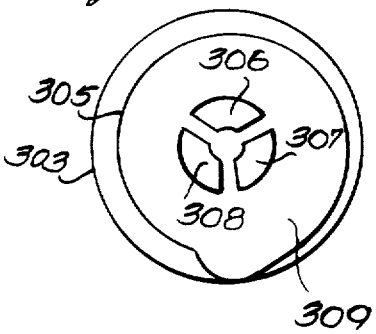

Adjusting plugs 69 and 70 can be identical in construction if so desired, and adjusting plug 69 is shown to enlarged scale in FIGS. 9–11. As seen in top view in FIG. 9, plug 69 has a neck portion 300 including a screwdriver slot 301 and an arrow 302. A collar 303 extends concentrically about neck portion 300 and defines a shoulder 304. When plug 69 is assembled with cover plate 54, a resilient rubber ring such as an O-ring 71 engages shoulder 304 providing a fluid tight seal and serving to bias the plug against metering surface 221 of metering plate 53. A spiral ledge 305 is disposed eccentrically with respect to collar 303 and is arranged to overlie a metering orifice such as orifice 214 in metering surface 221. Spiral ledge 305 defines a metering surface 309 on plug 69. Three spring fingers 306, 307, 308 are arranged in a circular pattern concentric with collar 303 and extend from metering surface 309. Spring fingers 306, 307 and 308 are of such dimension as to be easily inserted in a well such as 224 of metering plate 53. When the spring fingers are inserted in the well, spiral ledge 305 is related to a respective metering orifice such that rotation of the plug covers or uncovers the orifice to change the effective area thereof. Metering plug 70 is essentially identical to metering plug 69 and it is thought that a detailed description of plug 70 is not required.

Figure 12:
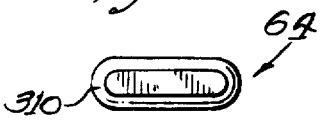
FIGS. 12, 13 are top and side views of a portion of the accelerator pump means shown to enlarged scale.
Figure 13:
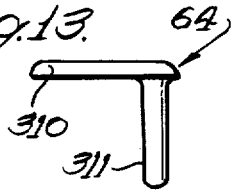

Accelerator pump shoe 64 is shown to enlarged scale in FIGS. 12 and 13 where it is seen to consist of a cap portion 310 and a stem portion 311. Cap portion 310 is arranged to engage upper diaphragm 67 while stem portion 311 serves to guide the shoe with respect to openings 103 and 184. The relationship of shoe 64 to other portions of the carburetor is shown to enlarged scale in fragmentary section view FIG. 8.

Figure 14:
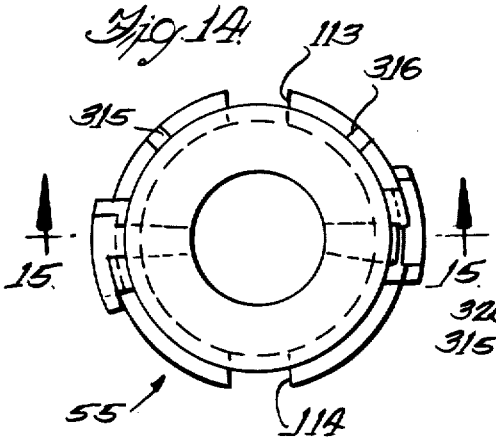
FIG. 14 is a top view of a throat member defining a fuel-air mixing passage shown to enlarged scale.
Figure 15:
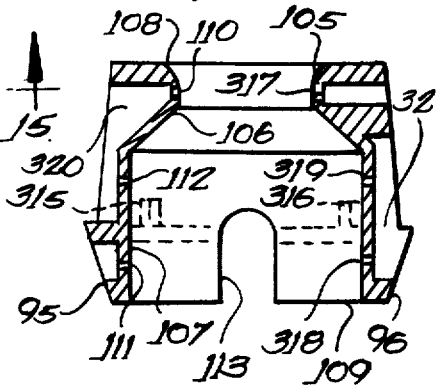
FIG. 15 is a section view of the throat member taken along the line 15—15 of FIG. 14.

Referring now to FIGS. 14 and 15, a multi-purpose throat member 55 is shown to enlarged scale including a pair of coding keys 315, 316 and an additional main fuel aperture 317, idle aperture 318 and transitional aperture 319. As seen in the left hand side of FIG. 15 main orifice 110 and transitional orifice 112 communicate with each other through slot 320 while idle orifice 111 is isolated therefrom. As seen in the right hand side of FIG. 15, idle orifice 318 communicates with transitional orifice 319 by means of slot 321 while main aperture 317 is isolated therefrom. A comparison of FIGS. 14, 19, 20 and 22 will provide a better understanding of the cooperation of coding keys 315, 316 with the coded notches 177, 178, 179, 180 for selecting which pattern of fuel orifices is rendered effective in a multi-purpose throat member. For example, if it is desired to render fuel apertures 317, 318, 319 effective, code key 316 should be engaged with code notch 178 in metering plate 53, in which case code notches 149 and 167 in the gasket 57 and diaphragm 59 should be open while code notches 148 and 166 should be left blank. On the other hand if it is desired to assemble throat member 55 so as to render fuel apertures 110, 111 and 112 effective, then code key 315 should be engaged with code notch 177 in the metering plate in which case only the code notches 148, 166 are formed in gasket 57 and diaphragm 59.

Figure 16:
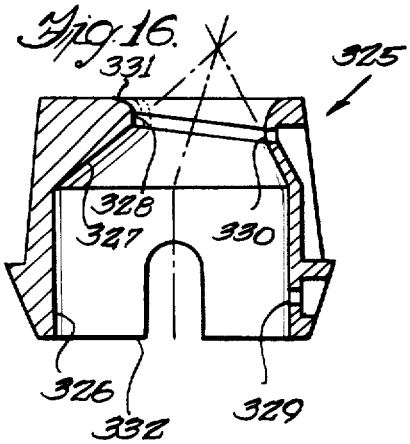
FIG. 16 is a section view similar to FIG. 15 of an alternate embodiment of throat member.

An alternate embodiment of throat member is designated by the reference character 325 and shown in section to enlarged scale in FIG. 16. Throat member 325 includes a cylindrical portion 326, an inclined frusto-conical portion 327 and a restricted band 328 defining a venturi section which is inclined and eccentric with respect to cylindrical portion 326. An idle fuel aperture 329 opens through a wall of cylindrical portion 326, and a main fuel aperture 330 opens into restricted band 328. Normally, flow through the throat is from the air inlet end 331 through the mixture outlet end 332, however, certain engines are known to impose cyclic reverse flow or rebound on the carburetor throat as a result of closure of the engine inlet valve. In some cases the reverse flow or rebound may create zones of static pressure adjacent a fuel aperture which can impede flow of fuel through the aperture into the mixing passage. The inclined and eccentric arrangement of the restricted band 328 and frusto-conical portion 327 permits unimpeded flow in the forward direction from air inlet end 331 to mixture outlet end 332, but creates turbulence if the mixture attempts to flow in the opposite direction thereby preventing the formation of static pressure zones which could interfere with proper flow of fuel through the fuel apertures into the mixing zone. The substitution of throat member 325 in place of throat member 55 may therefore be desirable when the carburetor is to be mounted on an engine known to create rebound pulses in the mixing passage.

Throttle member 56 is shown in perspective to enlarged scale in FIG. 17. The journal portions 99, 100, cam portions 102 and 104 and throttle plate 115 have been described hereinabove and it is thought to be unnecessary to repeat the description of the above named portions. In addition to the above, shaft portion 335 is provided with a slot 336 for engaging return spring 58, while shaft portion 337 is provided with a disc member 338 including openings 339. The openings 339 provide means for attaching an operating member to the throttle member such that it can be rotated against the bias of return spring 58.

A modified form of metering plate 345, cover plate 346 and high speed adjusting plug 347 is shown in fragmentary section in FIG. 26 which can be compared with FIG. 6. A plan view of the lower surface of the modified form of cover plate 346 is shown in FIG. 27 which is comparable with FIG. 25. Metering plug 347 includes a neck portion 348 having a screw driver slot 349 formed therein and a shoulder 350 surrounding neck portion 348. The lower portion of metering plug 347 has a collar 351 which is concentric with neck portion 348 and which is rotatable in a recess 352 in metering plate 345. An eccentric recess 353 is formed in the lower end surface of plug 347 arranged such that rotation of the plug is effective to vary the effective area of metering orifice 354. A vertical internal passage 355 includes a valve seat 356 arranged to receive check ball 357. A horizontal internal passage 358 provides communication between the check ball 357 and pocket wall 359. A narrow recess 360 provides communication between pocket wall 359 and the large opening 361 which embraces a throat member such as 55. If desired, the neck portion 348 of plug 347 can be provided with an opening 362 which is normally closed by a removable plug 363 in order to facilitate installation and removal of check ball 357. A similar construction of metering pocket and adjusting plug can be used for the idle system however, a check ball is not required in the idle system and as a result the metering plug for the idle system can be modified to eliminate the check ball and valve seat.

Comparison of modified cover plate 346, FIG. 27 with cover plate 54, FIG. 25 reveals that the openings and recesses are quite similar. Significant differences are that the high speed fuel outlet channel has been relocated, and that accelerator pump, sight glass and connecting fuel channel have been eliminated. An accelerator pump is desirable for some applications of the carburetor, but is not required for all such applications and may be eliminated when desired.

FIG. 28 is an exploded perspective view of a modified form of carburetor 370 which is substantially similar to the carburetor 50 described hereinabove. One difference between carburetor 50 and carburetor 370 is that the base plate 371, metering plate 372 and cover plate 373 are secured together by means of a pair of spring clips 374, 375 which eliminates the need for retaining screws. Spring clip 374 includes opposed upper 376 and lower 377 ridge portions arranged to engage the upper surface 378 of cover member 373 and a lower surface 379 of base plate 371. A cutout 380 is provide in clip 374 to permit passage of fuel inlet 'connector 381. Spring clip 375 includes opposed upper 382 and lower 383 ridges arranged for engagement with surfaces 378 and 379.

Figure 29:
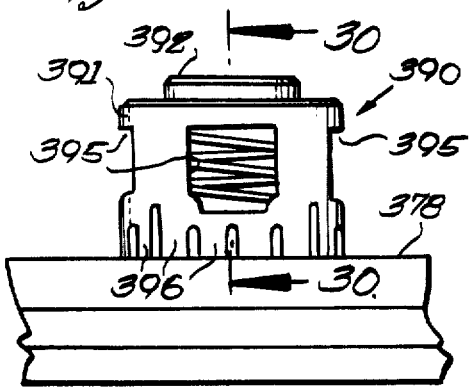
Figure 30:
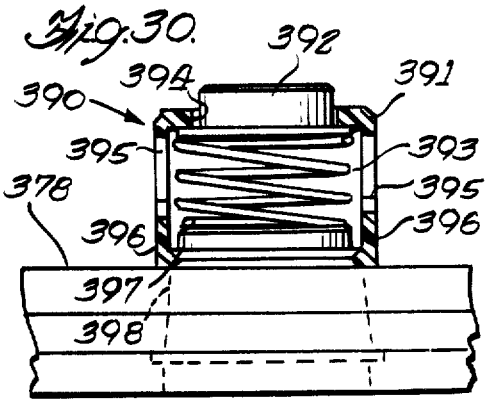

A further difference between carburetor 50 and carburetor 370 is the provision of a choke mechanism 390 which is shown in enlarged section view in FIGS. 29 and 30. Choke 390 includes a cup like air inlet member 391, a plunger 392 and a spring 393. Member 391 includes a central opening 394 for receiving plunger 392 and a series of peripheral air inlet openings 395. A series of spring fingers 396 is formed on member 391 arranged to engage with a grooved collar 397 protruding from upper surface 378. If desired, collar 397 can be formed as an extension of the air inlet end of a throat member 398. The arrangement of plunger 392 with respect to air inlet openings 395 is such that depression of the plunger reduces the effective area of the openings 395 thereby decreasing the flow area available for air inducted into the throat member.

A further modification of the carburetor is shown in FIGS. 31 and 32 where it is desired to provide optional orientation for a fuel connector. A modified metering plate 400 includes a tapered opening 401 communicating with a fuel cavity 402. An annular series of depressions 403 is disposed about the opening 401. A fuel tube connector 404 is provided with a spring finger detent portion 405, 406 extending from a conical portion 407, the conical portion being provided with sealing beads 408, 409. The body of connector 404 is also provided with raised portions 410 engageable with depressions 403. A tube connector nipple 411 extends from the body of tube connector 404. An internal passage 412 provides communication between the nipple end 411 and the detented end 405, 406 of connector 404. The connector 404 is assembled with metering plate 400 by inserting the conical portion 407 into tapered opening 401. When the tube connector is assembled with the metering plate, the spring fingers 405, 406 engage fuel cavity 402, the beads 408, 409 provide a fluid tight seal with opening 401 and raised portions 410 engage depressions 403 such that tube connector 404 is fixed in a desired orientation with respect to metering plate 400.

A further modified form of throat member 420 is shown to enlarged scale in FIGS. 33, 34 and 35. Referring to FIG. 33, throat member includes an internal cylindrical portion 421 joining a frusto-conical portion 422 which in turn joins a restricted band 423 defining a venturi, located between the mixture outlet end 424 and the air inlet end 425. As shown in FIG. 33, restricted band 423 is disposed eccentrically with respect to cylindrical portion 421. A main fuel aperture 426 opens through a wall of restricted band 423 providing communication with a fuel slot 427, and an idle fuel aperture 428 opens into cylindrical portion 421 of the mixing passage providing communication with idle fuel slot 429. The arrangement of conical portion 422 and eccentric restricted band 423 is effective to prevent the formation of static pressure zones in the mixing passage. Fuel slots 427 and 429 are provided with a pattern of raised beads 430, 431 extending around the slots which are compressed to form a fluid tight seal when the throat member is assembled with a corresponding base plate, metering plate and cover plate. A further modified feature of throat member 420 is that lateral ears 432, 433 are provided instead of beveled keys. Ears 432, 433 are of different lengths which provide an alternate means for coding a throat member for use with a corresponding metering plate and assuring that the fuel apertures in a throat member are correctly oriented with respect to a fuel module.

While it is believed that the operation of diaphragm carburetors is well understood by those skilled in the art, a brief explanation of the operation of the present carburetor will be given referring initially to FIGS. 5 and 6. The idle fuel channel means is shown in FIG. 5 in combination with a common portion of the fuel channel, while the main or high speed portion of the fuel channel is shown in FIG. 6 in combination with a common portion of the fuel channel.

Referring now to FIGS. 5, and 6 the tube connector 200 is connected to a source of fuel such as a fuel tank not shown in the drawings. Fuel is normally present in fuel cavity 201. Alternating pressure pulses are applied to a portion of diaphragm 59 through opening 119, such alternating pressure pulses being available from the crankcase of a reciprocating engine with which the carburetor is used. The application of such alternating pressure pulses to the diaphragm causes fuel to be withdrawn from cavity 201 through flap valve 253 into fuel pump recess 204 and then expelled from the fuel pump recess 204 through flap valve 256 into recess 289. As fuel is withdrawn from metering chamber 207 through orifices 213 or 214, the diaphragm rises causing valve 60 to open valve seat 208 which admits fuel to the metering chamber from recess 289.

When the throttle plate 115 is in closed, or idle, position as shown in FIG. 5, engine vacuum is imposed on idle orifice 111 and on idle channel portions 122, 234, 280 and around metering plug 70, to idle metering orifice 213, channel 281 and air bleed orifice 193. Engine vacuum is effective to draw air through air bleed inlet 127 and fuel through idle metering orifice 213 to create an air-fuel emulsion in the pocket around metering plug 70. The air-fuel emulsion is delivered to the mixing passage 107 through channel portions 280, 234, 122 and idle orifice 111.

When the throttle plate 115 is in the closed position as shown in FIG. 5, the accelerator pump cam 104 is in the inactive position shown in FIG. 8 which permits pump recess 287 to fill with fuel. Sight glass 73 provides a means of visual inspection to determine whether fuel is present adjacent the throat member.

When the throttle is moved to open position as shown in FIG. 6, accelerator pump cam 104 pushes upwardly on shoe 64 expelling fuel from cavity 287 through channel portion 286, 285, 283, 282, 225, 226, 227 and 228 into slot 320 and through fuel apertures 110, 112 into the mixing passage. Thereafter, the inducted air passing through restricted band 105 creates a vacuum condition in channel portions 228, 227, 226, 225 and recess 220 which draws fuel from metering chamber 207 through metering orifice 214. The purpose of check ball 65 is to prevent back bleeding of air through the high speed fuel channels when the carburetor is operated at idle condition.

In the foregoing description, a preferred embodiment of an improved carburetor construction together with modifications thereof has been described in detail. Among the advantages of the carburetor construction are that the fuel channels are formed as simple recesses and openings which avoids the drilling of complex intersecting passages. Another advantage is that components of the carburetor are designed for nested assembly with other components which facilitates assembly, avoids machine finishing to close tolerances and results in a compact assembly. A still further advantage of the carburetor is that certain components are formed for interlocking assembly with adjacent components which reduces the numbers of screw fasteners required, and provides a means of correctly orienting one component with respect to another during assembly. In addition, interlocking means can be provided in a form to facilitate the selection and assembly of a desired combination of interchangeable components. Many of the components can be formed of metal or synthetic resinous materials by simple molding processes.

What is claimed is:

1. A carburetor construction comprising:

a base plate having a substantially planar surface including an opening adapted for connection to an air inlet passage of an internal combustion engine, said opening defining a socket and said planar surface including a groove extending transversely with respect to said socket;

a throat member defining a fuel-air mixing passage mounted on said base plate having a mixture outlet portion thereof in alignment with said opening in said base plate, said throat member having an air inlet portion spaced from said mixture outlet portion and including fuel aperture means extending through a wall portion thereof between said air inlet portion and said mixture outlet portion, said throat member being received within said socket and including a pair of oppositely disposed slots aligned with said groove;

a rotatable throttle shaft extending through said slots and journalled in said groove, said throttle shaft including a throttle plate disposed in said mixture outlet portion of said throat member providing a variable restriction in said mixing passage; and a fuel module mounted on said base plate receiving said throat member including fuel channel means arranged and disposed for communication with a source of fuel and with said aperture means in said throat member, said base plate, throat member and fuel module being secured in interlocking engagement.

2. A carburetor construction according to claim 1, wherein said throttle shaft includes means engageable with an accelerator pump disposed in said fuel module, operable to supply a momentary injection of fuel through said aperture means responsive to movement of said throttle plate to an open position.

3. A carburetor construction according to claim 1, wherein said throat member includes first and second isolated patterns of circumferentially spaced fuel apertures, said throat member being receivable within said socket in either a first position or a second position for disposing a selected pattern of fuel apertures in communication with said fuel channel.

4. A carburetor construction according to claim 1, wherein said slots are disposed in a selected relationship with respect to said fuel aperture means, said throttle plate having an edge portion movable with respect to said fuel aperture means in response to turning of said throttle shaft.

5. A carburetor construction according to claim 4, wherein said fuel aperture means includes an idle fuel aperture disposed adjacent said base plate and a main fuel aperture spaced therefrom, said throttle plate edge portion being arranged for isolating said idle aperture from said main aperture in a closed position, said fuel module including a high speed adjusting plug controlling communication between said main fuel aperture and a common portion of said fuel channel means and an idle adjusting plug controlling communication between said idle fuel aperture and said common portion of said fuel channel means.

6. A carburetor construction comprising:

a base plate having a substantially planar surface including an opening adapted for connection to an air inlet passage of an internal combustion engine;

a throat member defining a fuel-air mixing passage mounted on said base plate having a mixture outlet portion thereof in alignment with said opening in said base plate, said throat member having an air inlet portion spaced from said mixture outlet portion and including fuel aperture means extending through a wall portion thereof between said air inlet portion and said mixture outlet portion; and a fuel module mounted on said base plate receiving said throat member including fuel channel means arranged and disposed for communication with a source of fuel and with said aperture means in said throat member, said fuel module including a metering pocket having an end surface, said end surface having a metering orifice defined therein forming a portion of said fuel channel means, said fuel module including a rotatable adjusting plug received in said metering pocket having a spiral ledge defining a metering surface lapping said metering orifice arranged for varying the flow area of said metering orifice in response to rotation of said plug, said metering surface being biased into engagement with said end surface of said metering pocket by means of a resiliently deformable ring engaging a shoulder formed on said adjusting plug and a shoulder formed in said metering pocket.

7. A carburetor construction according to claim 6, wherein said rotatable adjusting plug includes an internal passage communicating with said metering surface, said internal passage forming a portion of said fuel channel means.

8. A carburetor construction according to claim 7, wherein said rotatable adjusting plug includes a one-way check valve disposed in said internal passage arranged for controlling the direction of flow in said fuel channel means.

9. A carburetor construction comprising:

a base plate having a substantially planar surface including an opening adapted for connection to an air inlet passage of an internal combustion engine, and including a first recess defining a portion of a metering chamber;

a throat member defining a fuel-air mixing passage mounted on said base plate having a mixture outlet portion thereof in alignment with said opening in said base plate, said throat member having an air inlet portion spaced from said mixture outlet portion and including fuel aperture means extending through a wall portion thereof between said air inlet portion and said mixture outlet portion; and a fuel module mounted on said base plate receiving said throat member including fuel channel means arranged and disposed for communication with a source of fuel and with said aperture means in said throat member, said fuel module including a first resilient membrane, a metering plate, a second resilient membrane, and a cover plate stacked one upon the other and secured to said base plate, said metering plate including a recess formed in a lower surface thereof cooperating with said first recess and said first resilient membrane to form a portion of said metering chamber, said metering chamber communicating with said source of liquid fuel, said metering plate including a metering pocket communicating with said metering chamber, and an adjusting plug having a portion extending through said cover plate and having another portion received within said metering pocket, said extending portion of said plug including means for adjustably rotating said plug within said pocket, and said other portion of said plug including means for adjustably restricting communication between said metering chamber and pocket, said metering chamber and adjusting plug forming a portion of said fuel channel means.

10. A carburetor construction according to claim 9, wherein said base plate and said metering plate include substantially congruent recesses separated by said first resilient membrane, said recess in said base plate being adapted for communication with a source of pulsating pressure and said recess in said metering plate communicating with a source of fuel and with said metering chamber, said recesses and membrane providing a pump for circulating fuel to said metering chamber.

11. A carburetor construction comprising:

a base plate having a substantially planar surface including an opening adapted for connection to an air inlet passage of an internal combustion engine;

a throat member defining a fuel-air mixing passage mounted on said base plate having a mixture outlet portion thereof in alignment with said opening in said base plate, said throat member having an air inlet portion spaced from said mixture outlet portion and including fuel aperture means extending through a wall portion thereof between said air inlet portion and said mixture outlet portion;

said throat member including a substantially cylindrical internal wall portion merging into a substantially frusto-conical internal wall portion, the axes of said frusto-conical portion and said cylindrical portion being inclined with respect to each other, said frusto-conical portion including a restricted band defining a venturi disposed between said air inlet portion and said mixture outlet portion; and a fuel module mounted on said base plate receiving said throat member including fuel channel means arranged and disposed for communication with a source of fuel and with said aperture means in said throat member, said base plate, throat member and fuel module being secured in interlocking engagement.

* * * * *